US008973272B2

(12) United States Patent
Moon et al.

(10) Patent No.: US 8,973,272 B2
(45) Date of Patent: Mar. 10, 2015

(54) RAZOR CARTRIDGE

(75) Inventors: Hyun Seok Moon, Gunpo-si (KR); Kyung Sik Lee, Ansan-si (KR)

(73) Assignee: Dorco Co., Ltd, Gyeonggi-Do (KR)

( * ) Notice: Subject to any disclaimer, the term of this patent is extended or adjusted under 35 U.S.C. 154(b) by 305 days.

(21) Appl. No.: 13/393,825

(22) PCT Filed: Jun. 17, 2010

(86) PCT No.: PCT/KR2010/003897

§ 371 (c)(1),
(2), (4) Date: Mar. 1, 2012

(87) PCT Pub. No.: WO2011/027962

PCT Pub. Date: Mar. 10, 2011

(65) Prior Publication Data

US 2012/0151772 A1 Jun. 21, 2012

(30) Foreign Application Priority Data

Sep. 1, 2009 (KR) ..... 10-2009-0082142

(51) Int. Cl.
*B26B 21/22* (2006.01)
*B26B 21/44* (2006.01)
*B26B 21/40* (2006.01)

(52) U.S. Cl.
CPC ..... *B26B 21/225* (2013.01); *B26B 21/4012* (2013.01); *B26B 21/4018* (2013.01); *B26B 21/4025* (2013.01); *B26B 21/4068* (2013.01)
USPC ..... 30/50; 30/41

(58) Field of Classification Search
USPC ..... 30/47, 50
See application file for complete search history.

(56) References Cited

U.S. PATENT DOCUMENTS

| | | | | |
|---|---|---|---|---|
| 5,369,885 | A * | 12/1994 | Ferraro | 30/41 |
| 5,661,907 | A * | 9/1997 | Apprille, Jr. | 30/47 |
| 6,141,875 | A | 11/2000 | Andrews | |
| 6,161,287 | A * | 12/2000 | Swanson et al. | 30/50 |
| 6,161,288 | A * | 12/2000 | Andrews | 30/50 |
| 6,349,471 | B1 * | 2/2002 | Gruslin et al. | 30/50 |
| 6,601,303 | B2 * | 8/2003 | Gilder et al. | 30/50 |
| 6,877,227 | B2 * | 4/2005 | Santhagens Van Eibergen et al. | 30/50 |
| 7,100,284 | B2 * | 9/2006 | King | 30/49 |

(Continued)

FOREIGN PATENT DOCUMENTS

| | | |
|---|---|---|
| KR | 10-0669144 | 11/2001 |
| WO | 2004-037037 | 5/2004 |

OTHER PUBLICATIONS

International Search Report for PCT/KR2010/003897 Mailed Jan. 31, 2011.

*Primary Examiner* — Hwei C Payer
(74) *Attorney, Agent, or Firm* — AKC Patents, LLC; Aliki K. Collins

(57) ABSTRACT

The present invention relates to a razor cartridge capable of simultaneously shaving flat and sharply curved surfaces, said razor cartridge comprising: a blade housing, on which a plurality of razor blades are formed; and an upper housing coupled to the blade housing and defining a rectangular opening for outwardly exposing the edges of the razor blades to enable the latter to contact the skin, wherein the blade housing includes a first razor blade mounting portion and a second razor blade mounting portion that define a plurality of slots to which the razor blades are coupled, and a hinge portion connects the first razor blade mounting portion and the second razor blade mounting portion.

18 Claims, 6 Drawing Sheets

(a)

(b)

(56) References Cited

U.S. PATENT DOCUMENTS

| | | | | |
|---|---|---|---|---|
| 7,200,938 | B2 * | 4/2007 | Lembke | 30/50 |
| 7,610,683 | B2 * | 11/2009 | Brown et al. | 30/50 |
| 7,621,203 | B2 * | 11/2009 | Aviza | 83/13 |
| 7,681,314 | B2 * | 3/2010 | Follo | 30/34.2 |
| 7,703,361 | B2 * | 4/2010 | Johnson et al. | 83/13 |
| 7,992,304 | B2 * | 8/2011 | Nakasuka | 30/50 |
| 8,359,752 | B2 * | 1/2013 | Bridges | 30/50 |
| 8,407,900 | B2 * | 4/2013 | Johnson | 30/50 |
| 2003/0033717 | A1 | 2/2003 | Cecil | |
| 2006/0277769 | A1 | 12/2006 | Coffin et al. | |
| 2009/0193659 | A1 * | 8/2009 | Park et al. | 30/50 |
| 2009/0288304 | A1 * | 11/2009 | Denkert et al. | 30/346.61 |
| 2011/0192031 | A1 * | 8/2011 | Coresh | 30/34.2 |
| 2011/0232101 | A1 * | 9/2011 | Park et al. | 30/50 |
| 2012/0151772 | A1 * | 6/2012 | Moon et al. | 30/41 |

* cited by examiner (a)

(b)

(a)

(b)

(a)

(b)

(a)

(b)

RAZOR CARTRIDGE

RELATED APPLICATIONS

This application is a 371 application of International Application No. PCT/KR2010/003897, filed Jun. 17, 2010, which in turn claims priority from Korean Patent Application No. 10-2009-0082142, filed Sep. 1, 2009, each of which is incorporated herein by reference in its entirety.

TECHNICAL FIELD

The present invention relates to a wet razor, and more particularly, to a razor cartridge capable of simultaneously shaving flat and sharply curved surfaces.

BACKGROUND ART

A wet razor can be largely classified as male razor and female razor. While there were a lot of studies on the male razor, the female razor tended to employ the male razor as is. It was not until the start of the 2000s that cartridges exclusively for female use were launched on the market.

The body hair of women is much softer than that of men, and there arise a lot of problems in employing cartridges mounted in the male razor to female razor. Also, women shave more various parts of the body such as the armpit, arms, legs and bikini line than men. In this regard, it is important to manufacture a cartridge in consistent with the shaved part of the body. For effective shaving, it is important to manufacture a cartridge suitable for each shaved part, but it is not realistic to manufacture the cartridge suitable for each part due to manufacturing costs and other circumstances.

For example, the part of the body such as arms or legs do not have curves and are relatively smooth. In the case of a relatively smooth part such as legs, a cartridge, which has a large skin-contacting surface and is flat, is suitable. However, when a sharply curved part such as the armpit should be shaved, a cartridge which has a curved skin-contacting surface or a narrower skin-contacting surface would be suitable.

Female razors which are on the market have a rectangular and flat shape like other general razors without taking into account the physical features as above. Accordingly, a lot of female users suffer inconvenience during shaving of the armpit.

DISCLOSURE

Technical Problem

The present invention has been made to solve the problems and it is an object of the present invention to provide a razor cartridge capable of simultaneously shaving flat and sharply curved surfaces.

It is another object of the present invention to provide a razor cartridge which is bent along a curved area.

It is another object of the present invention to provide a razor cartridge capable of changing the blade features depending on an area of the cartridge and minimizing damage to the skin.

Technical Solution

In order to achieve the object of the present invention, a razor cartridge comprises a blade housing, on which a plurality of razor blades is formed; and an upper housing coupled to the blade housing and defining a rectangular opening for outwardly exposing the edges of the razor blades to enable the latter to contact the skin, wherein the blade housing comprises a first razor blade mounting portion and a second razor blade mounting portion that define a plurality of slots to which the razor blades are coupled, and a hinge portion connects the first razor blade mounting portion and the second razor blade mounting portion.

The hinge portion comprises an elastic polymer material.

A gap between slots of the first razor blade mounting portion is the same as, or wider than, a gap of slots of the second razor blade mounting portion 24.

The number of the razor blades of the first razor blade mounting portion is the same as, or higher than, the number of the razor blades of the second razor blade mounting portion.

The first and second razor blade mounting portions and the hinge portion are integrally formed, and the hinge portion is shaped like an arch.

The razor blades are formed in the same line of a skin-contacting line extending in parallel with a skin-contacting surface of the upper housing or below the skin-contacting line.

The razor blades of the first razor blade mounting portion are formed farther from the skin-contacting line than the razor blades of the second razor blade mounting portion.

The plurality of slots is formed in opposite ends and in the central part of the razor blade mounting portions to support the razor blades.

The upper housing has two lubricating bands which comprise a shaving supporter and are adjacent to the rectangular opening.

The lubricating bands comprise a plurality of grooves which is formed in a lengthwise direction.

The two lubricating bands comprise different compositions.

The upper housing comprises a brush which has a plurality of projections and is adjacent to the lubricating bands and washes off the shavings.

The brush comprises an elastomer material.

The upper housing has a concave groove formed in opposite lateral walls of the upper housing to be coupled to the hinge portion.

The upper housing comprises retainers to prevent the razor blades from being separated from the upper housing.

The retainers comprise a first retainer which is formed on the top of the first razor blade mounting portion and a second retainer which is formed on the top of the second razor blade mounting portion.

A blank space is formed between the first and second retainers.

Advantageous Effect

As described above, a razor cartridge according to the present invention is capable of simultaneously shaving the flat and sharply curved surfaces by being closely adhered to the surfaces.

Further, a razor cartridge according to the present invention is capable of changing the blade features depending on an area of the cartridge and minimizing damage to the skin.

BEST MODE

The present invention provides a device which has a cartridge as a hinge type and operates more smoothly when pressure is applied.

Hereinafter, a razor cartridge according to an exemplary embodiment of the present invention will be described with reference to accompanying drawings.

Figure 1:
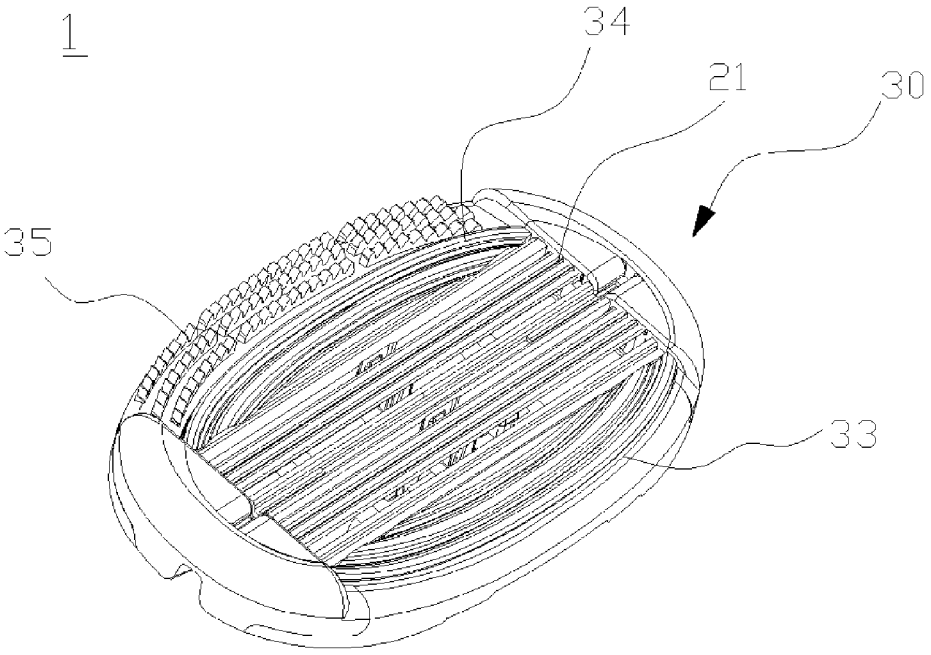
FIG. 1 is a perspective view of a cartridge according to the present invention, wherein (a) is a top view and (b) is a bottom view.
Figure 1:
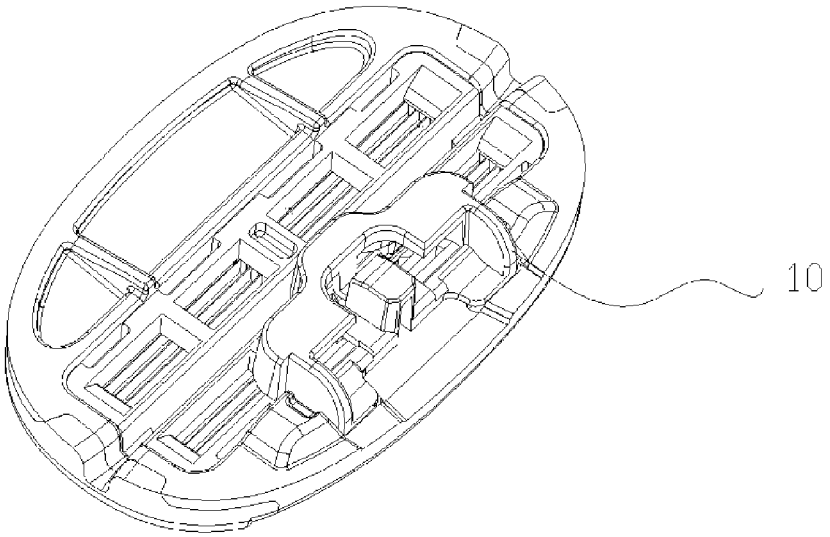
Figure 2:
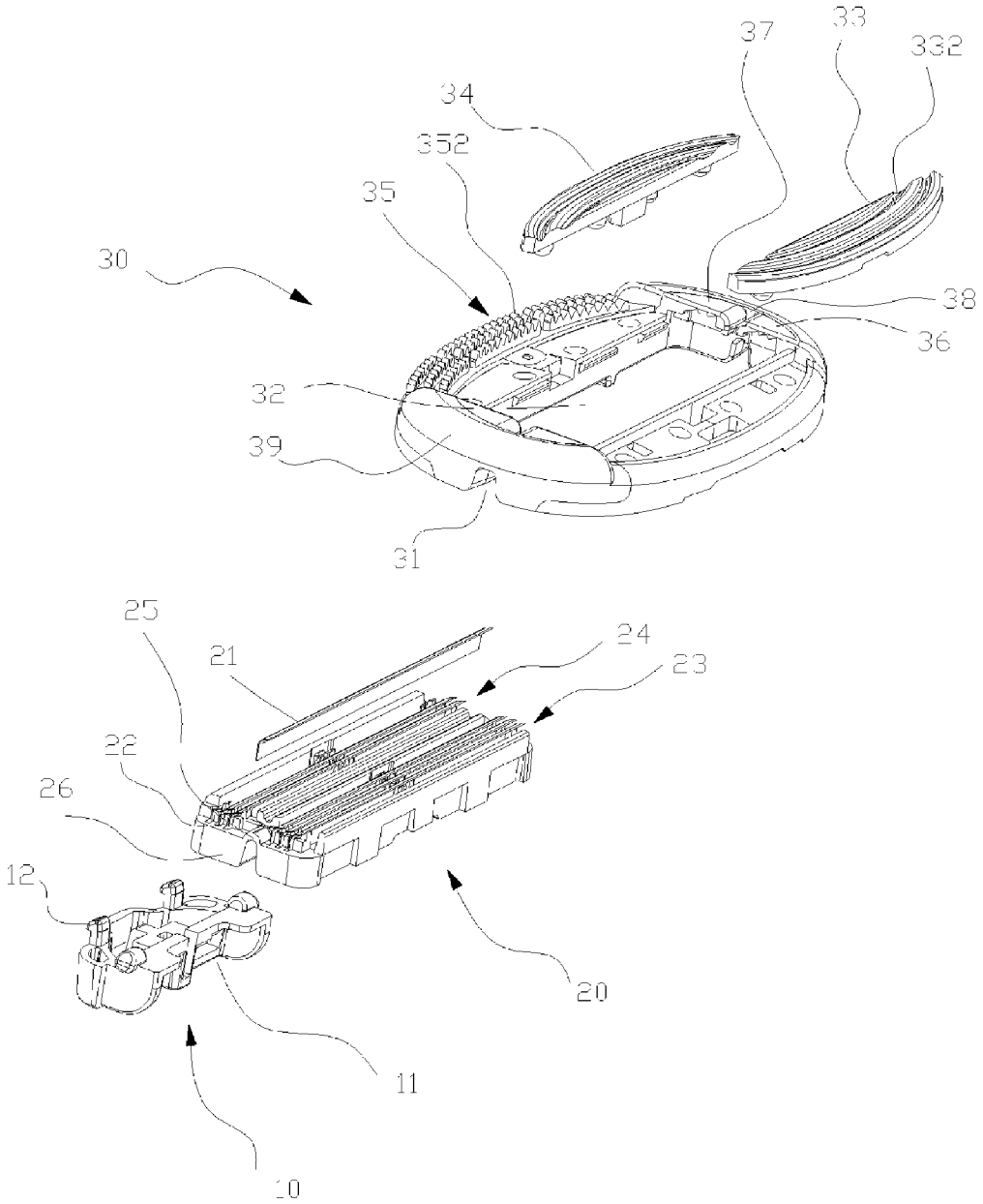
FIG. 2 is an exploded perspective view of the cartridge in FIG. 1.

FIG. 1 is a perspective view of a cartridge 1 according to the present invention. FIG. 2 is an exploded perspective view of the cartridge 1 in FIG. 1.

(a) in FIG. 1 is the razor cartridge 1 shown from above, and (b) in FIG. 1 is the razor cartridge 1 shown from below. A plurality of razor blades 21 is integrally coupled. Lubricating bands 33 and 34 and a brush 35 which is shaped like a projection are formed on the top of an upper housing 30. A handle coupler 10 is coupled to a bottom of the upper housing 30.

More specifically, referring to FIG. 2, the razor cartridge 1 includes the handle coupler 10 which is coupled to a razor handle (not shown), a blade housing 20 which is coupled to the handle coupler 10, and the upper housing 30 which is coupled to the blade housing 20.

The handle coupler 10 includes a hollow part 11 into which the handle of the razor is inserted, and a coupling projection 12 which is coupled to the blade housing 20.

Slots 22 are formed in the blade housing 20 in the same number as the number of the plurality of blades 21 to be coupled with the blades 21. A hinge portion 25 is formed in a central part of the blade housing 20. A first razor blade mounting portion 23 is forwardly formed and a second razor blade mounting portion 24 is backwardly formed in the blade housing 20, centering on the hinge portion 25. The hinge portion 25 connects the first and second razor blade mounting portions 23 and 24 and has an arch shape. The hinge portion 25 may be formed by using an elastic polymer so that it may easily move by external force. The hinge portion 25 which has an arch shape is not limited in thickness, but may be thinner than the thickness of a partition wall 26 of the first and second razor blade mounting portions 23 and 24. The first and second razor blade mounting portions 23 and 24 may individually move by the hinge portion 25. Accordingly, even if a curved part such as the armpit is shaved, the razor cartridge 1 is bent along the curved surface and is capable of shaving the part by being closely adhered thereto. The first and second razor blade mounting portions 23 and 24 and the hinge portion 25 may be formed separately and then coupled to each other, or may be formed integrally by injection molding. Even if the first and second razor blade mounting portions 23 and 24 and the hinge portion 25 are integrally formed, the purpose of the present invention may be fully achieved if the hinge portion 25 employs an elastic polymer having good flexibility and dynamic stability, and is shaped like an arch in a thin thickness as shown in FIG. 2.

The features of the first and second razor blade mounting portions 23 and 24 will be described later.

The upper housing 30 is coupled to the blade housing 20, and has a concave groove 31 formed therein to be coupled to the hinge portion 25 which is shaped like an arch. The upper housing 30 defines a rectangular opening 32 for outwardly exposing the razor blades 21 to enable the razor blades 21 to contact the skin. Two lubricating bands 33 and 34 and a single brush 35 may be coupled to the top of the upper housing 30.

The two lubricating bands 33 and 34 are coupled to a front side and a rear side of the opening portion 32, respectively. The lubricating bands 33 and 34 include a lubricating material including a mixture of hydrophobic material and hydrophilic polymer material and thus reduce the frictional force against the skin during shaving. It is not impossible to shave only with the first lubricating band 33, but provision of the second lubricating band 34 in the rear side may ensure a smoother shaving. A plurality of concave grooves may be formed in the lubricating bands 33 and 34. The material of the lubricating bands 33 and 34 may include a functional material in various types depending on the use of purpose. For example, a functional material which has a whitening function or a functional material which has an anti-aging function may be included. The first and second lubricating bands 33 and 34 may have not only the same material, but also different materials. A plurality of grooves 332 may be formed in the lubricating band 33 in a lengthwise direction to provide the tension effect of the skin.

The brush 35 is formed in the rear side of the upper housing 30 to be adjacent to the second lubricating band 34. A plurality of projection lines including a plurality of projections 352 is formed in the brush 35. The projections 352 include an elastic material to be smoothly bent when the force is applied thereto. The brush 35 including the elastic projections 352 may brush off the body hair which has been cut by the razor blade. The elastic material may include an elastomer material.

Retainers 36 and 37 may be formed in opposite edges of the upper housing 30 to prevent the razor blade from being separated from the upper housing 30 and to firmly fix the razor blade thereto. The retainers 36 and 37 are formed on the top of the first and second razor blade mounting portions 23 and 24, respectively, and are open 38 on the top of the hinge portion 25. That is, as the upper housing 30 should move along with the movement of the hinge portion 25, the opposite later walls 39 include an elastomer material, and concave groove 31 and a blank space 38 are formed in the central part so that the retainers 36 and 37 are formed to be most flexible to be bent together with the blade housing 20 when the force is applied thereto.

Figure 3:
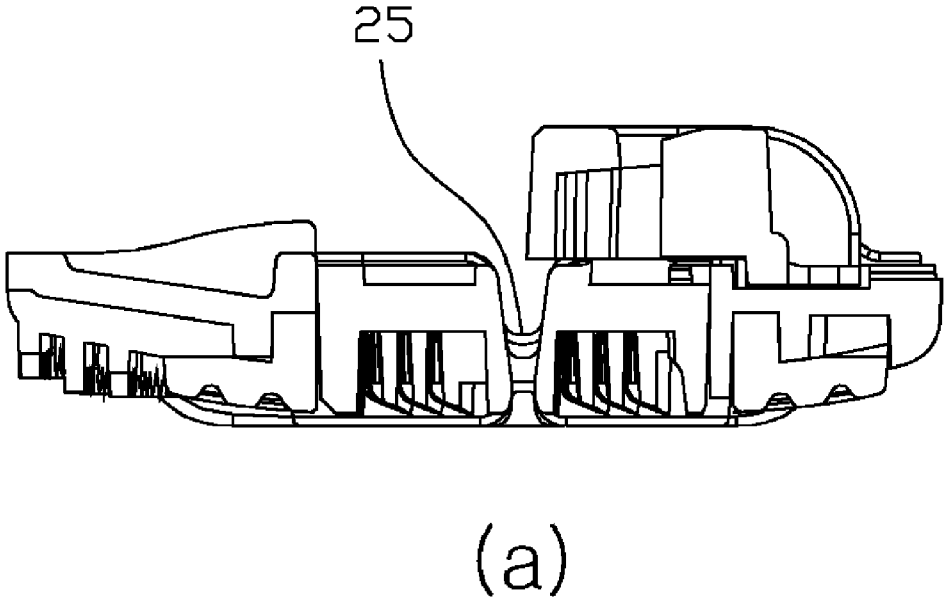
FIG. 3 is a sectional view of the cartridge according to the present invention, wherein (a) illustrates the cartridge when no force is applied thereto and (b) illustrates the cartridge when force is applied thereto and the hinge portion is bent.
Figure 3:
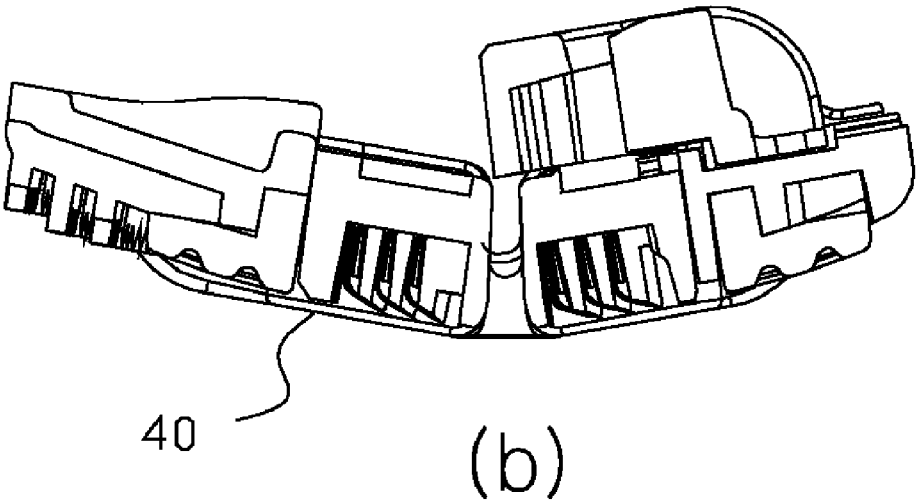

FIG. 3 is a sectional view of the razor cartridge 1 according to the present invention.

(a) in FIG. 3 illustrates the razor cartridge 1 when no force is applied thereto. (b) in FIG. 3 illustrates the razor cartridge 1 when a certain force is applied and the hinge portion 25 is bent. Referring to FIG. 3, the razor cartridge 1 is bent, centering on the hinge portion 25 so that a skin-contacting surface 40 forms a curved line.

Figure 4:
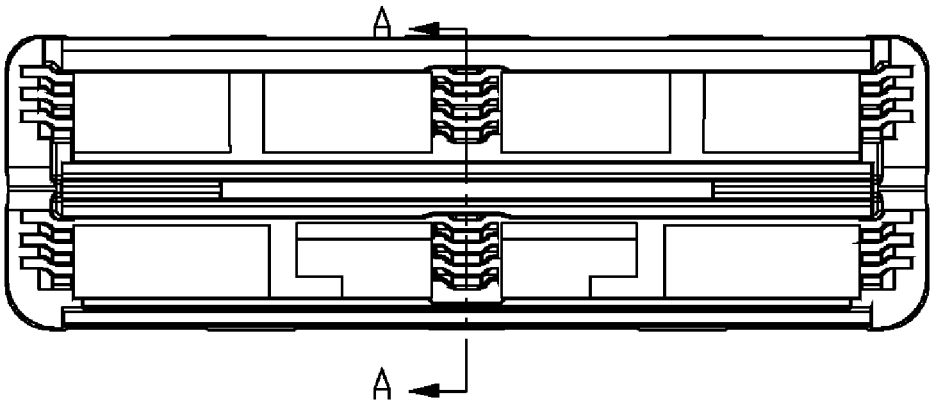
FIG. 4 is a detailed view of a blade housing 20, wherein (a) is a top plan view of the blade housing and (b) is a sectional view of the blade housing cut along A-A.
Figure 4:
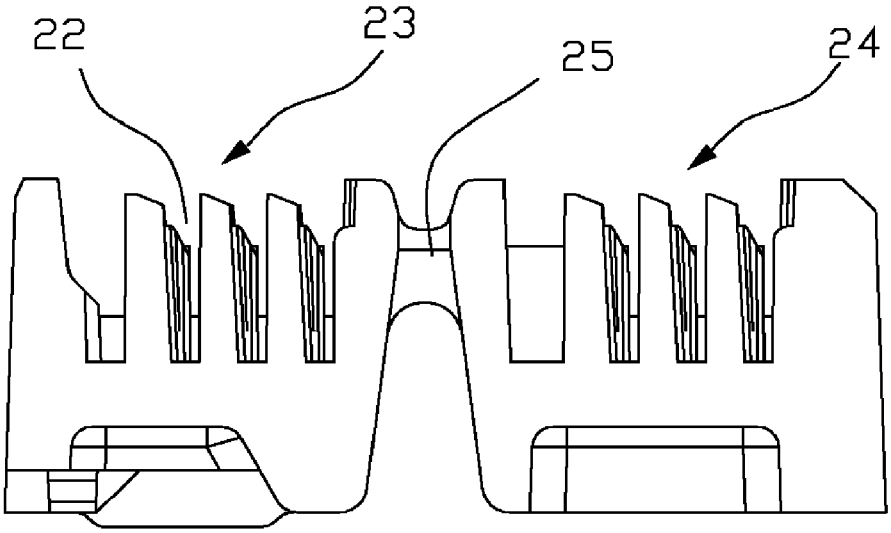

FIG. 4 is a detailed view of the blade housing 20, wherein (a) is an upper plan view of the blade housing 20 and (b) is sectional view of the blade housing 20, cut along A-A.

Referring to FIG. 4, a plurality of slots 22 is formed in the first and second razor blade mounting portions 23 and 24. The slots 22 may be formed in not only the edges of the blade housing 20 but also in the central part to prevent a movement of the razor blade. According to the present exemplary embodiment, three slots 22 are formed in the first and second razor blade mounting portions 23 and 24, respectively, but not limited thereto. Alternatively, the number of slots 22 may vary.

Figure 5:
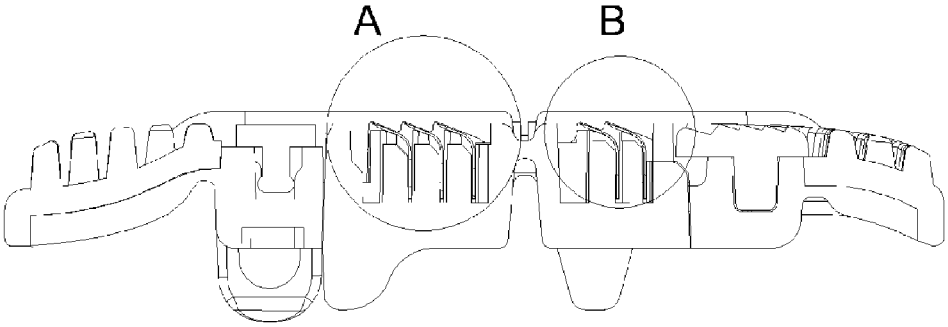
FIG. 5 is a lateral view of the razor cartridge to which a razor blade is coupled, wherein (a) is a lateral view of the razor cartridge to which the razor blade coupled, and (b) is a partial enlarged view of the razor cartridge.
Figure 5:
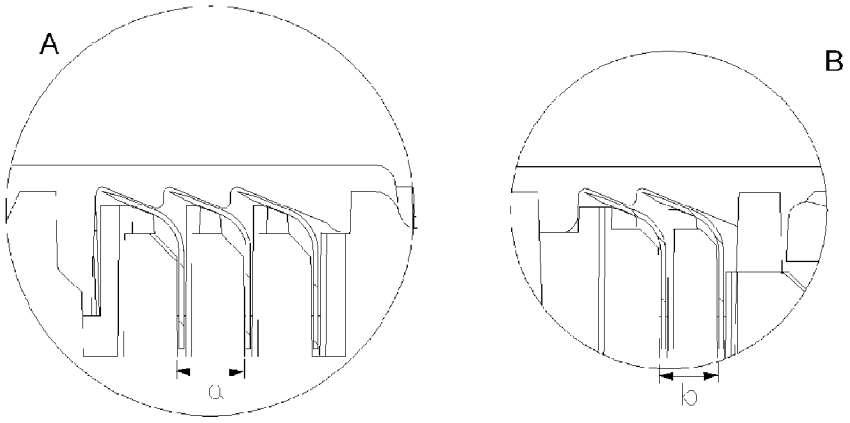

(a) in FIG. 5 is a lateral view of the razor cartridge 1 to which the razor blade is coupled. (b) in FIG. 5 is a partial enlarged view of the razor cartridge 1.

Referring to FIG. 5, three razor blades are formed in the first razor blade mounting portion 23, and two razor blades are formed in the second razor blade mounting portion 24. A gap between the razor blades of the first razor blade mounting portion 23 is wider than the gap of the razor blades of the second razor blade mounting portion 24 to be suitable for cutting long hair. The gap (a) between the razor blades of the first razor blade mounting portion 23 may range from 1.0 to 1.02 mm. The gap (b) between the razor blades of the second razor blade mounting portion 24 may range from 0.7 to 0.95 mm. A blade projection value (distance between the skin-contacting surface and the edges of the razor blade) is different. To express that the razor blade does not protrude and is located below the skin-contacting surface, a negative value (−) has been used. The skin-contacting surface 40 (refer to FIG. 3) means the surface contacting the skin during shaving, which is a virtual reference surface connecting the two lubricating bands 33 and 34. The razor blades of the first razor blade mounting portion 23 may be deeper than the razor blades of the second razor blade mounting portion 24. That is, an absolute value of the projection value of the razor blades of the first razor blade mounting portion 23 is larger than that of the second razor blade mounting portion 24. More preferably, the projection value of the first razor blade mounting portion 23 may range from −0.05 to −0.02 mm, and the projection value of the second razor blade mounting portion 24 may range from −0.02 to 0 mm.

Figure 6:
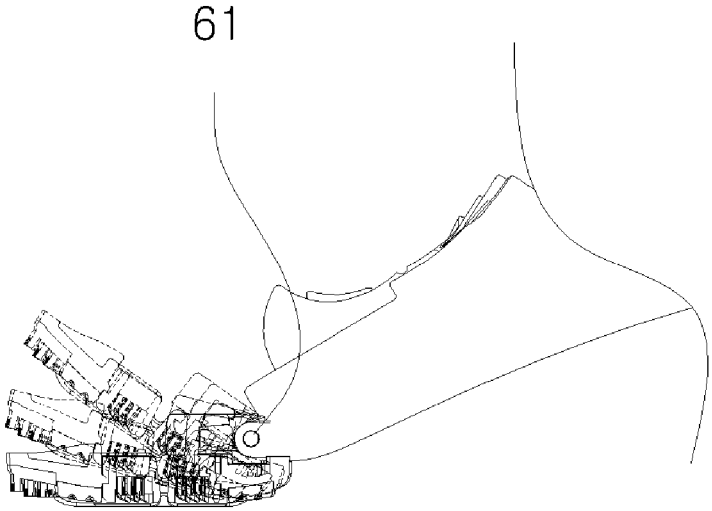
FIG. 6 illustrates usage state of the razor according to features of the parts of the body according to the present invention, wherein (a) illustrates use of the razor for shaving an uncurved and relatively smooth part, and (b) illustrates the use of the razor as the skin-contacting surface of the cartridge is rounded according to a curved part.
Figure 6:
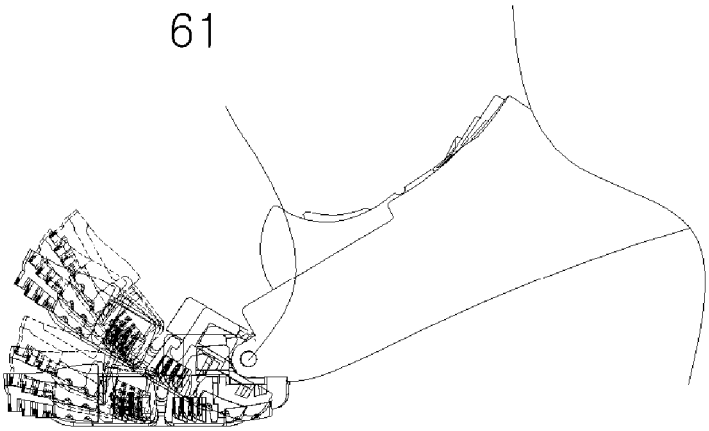

FIG. 6 illustrates the effect of the razor which shaves consistently with the features of each part of the body. (a) in FIG. 6 illustrates use of the razor for shaving an uncurved and relatively smooth part such as arms or legs, wherein the skin-contacting surface of the razor cartridge 1 is used in a flat state. (b) in FIG. 6 illustrates the use of the razor as the skin-contacting surface of the cartridge is rounded according to a curved part such as the armpit by realizing the features of the hinge portion 25 of the razor cartridge 1 according to the present invention.

The razor cartridge 1 pivots and is coupled to a razor handle. In (a) in FIG. 6, the razor cartridge 1 pivots centering on a coupling shaft 61 but in (b) in FIG. 6, the razor cartridge 1 not only pivots but also is bent again and moves, centering on the hinge portion 25.

As described above, a razor cartridge according to the present invention smoothly moves, centering on a hinge portion, and shaves even a curved part of the body such as the armpit more efficiently.

The invention claimed is:

1. A razor cartridge comprising:

a blade housing, on which a plurality of razor blades is formed;

an upper housing coupled to the blade housing and defining a rectangular opening for outwardly exposing cutting edges of the razor blades to enable the latter to contact skin;

wherein the blade housing comprises a first razor blade mounting portion and a second razor blade mounting portion that define a plurality of slots to which the razor blades are coupled, and a hinge portion connects the first razor blade mounting portion and the second razor blade mounting portion; and wherein the upper housing has a concave groove formed in opposite lateral walls of the upper housing to be coupled to the hinge portion.

2. The razor cartridge according to claim 1, wherein the hinge portion comprises an elastic polymer material.

3. The razor cartridge according to claim 1, wherein a gap between slots of the first razor blade mounting portion is the same as, or wider than, a gap of slots of the second razor blade mounting portion.

4. The razor cartridge according to claim 1, wherein the number of the razor blades of the first razor blade mounting portion is the same as the number of the razor blades of the second razor blade mounting portion.

5. The razor cartridge according to claim 1, wherein the number of the razor blades of the first razor blade mounting portion is higher than the number of the razor blades of the second razor blade mounting portion.

6. The razor cartridge according to claim 5, wherein the hinge portion is shaped like an arch.

7. The razor cartridge according to claim 1, wherein the first and second razor blade mounting portions and the hinge portion are integrally formed.

8. The razor cartridge according to claim 1, wherein the razor blades are formed in the same line of a skin-contacting line extending in parallel with a skin-contacting surface of the upper housing or below the skin-contacting line.

9. The razor cartridge according to claim 8, wherein the razor blades of the first razor blade mounting portion are formed farther from the skin-contacting line than the razor blades of the second razor blade mounting portion.

10. The razor cartridge according to claim 1, wherein the plurality of slots is formed in opposite ends and in the central part of the razor blade mounting portions to support the razor blades.

11. The razor cartridge according to claim 1, wherein the upper housing has two lubricating bands which comprise a shaving supporter and are adjacent to the rectangular opening.

12. The razor cartridge according to claim 11, wherein the lubricating bands comprise a plurality of concave grooves which is formed in a lengthwise direction.

13. The razor cartridge according to claim 11, wherein the two lubricating bands comprise different compositions.

14. The razor cartridge according to claim 11, wherein the upper housing comprise a brush which has a plurality of projections and is adjacent to one of the lubricating bands and washes off shavings.

15. The razor cartridge according to claim 14, wherein the brush comprises an elastomer material.

16. The razor cartridge according to claim 1, wherein the upper housing comprises retainers to prevent the razor blades from being separated from the upper housing.

17. The razor cartridge according to claim 16, wherein the retainers comprise a first retainer which is formed on the top of the first razor blade mounting portion and a second retainer which is formed on the top of the second razor blade mounting portion.

18. The razor cartridge according to claim 17, wherein a blank space is formed between the first and second retainers.

* * * * *